United States Patent [19]

Watson et al.

[11] Patent Number: 4,567,608

[45] Date of Patent: Jan. 28, 1986

[54] MICROPHONE FOR USE ON LOCATION

[75] Inventors: Alan R. Watson, Niles; John P. Overley, Buchanan, both of Mich.

[73] Assignee: Electro-Voice, Incorporated, Buchanan, Mich.

[21] Appl. No.: 592,411

[22] Filed: Mar. 23, 1984

[51] Int. Cl.[4] ..... H04R 3/00

[52] U.S. Cl. ..... 381/122; 381/115; 381/120; 381/111

[58] Field of Search ..... 381/77, 91, 92, 111, 381/115, 120, 122; 179/81 B

[56] References Cited

U.S. PATENT DOCUMENTS

| | | | |
|---|---|---|---|
| 3,748,397 | 7/1973 | Jones | 381/77 |
| 4,315,109 | 2/1982 | Jacobsen | 179/81 B |
| 4,378,467 | 3/1983 | Ferrantelli | 381/111 |
| 4,396,800 | 8/1983 | McDonnell et al. | 381/122 |

*Primary Examiner*—Forester W. Isen

*Attorney, Agent, or Firm*—Burmeister, York, Palmatier, Hamby & Jones

[57] ABSTRACT

A microphone designed for use on location provided with amplification to produce a signal output level suitable for use on conventional studio cables and utilizing the Phantom power available on such studio cables, the microphone having a light emitting diode responsive to elevation of the potential of the Phantom power on the cable, but not the normal potential thereof, to indicate the presence of a live microphone, the microphone also being provided with a backup battery for use in the event Phantom power is not available, and the microphone being provided with a free running multivibrator coupled to the light emitting diode and having a repetition rate proportional to the potential of the backup battery to give an indication of battery voltage.

8 Claims, 3 Drawing Figures

MICROPHONE FOR USE ON LOCATION

The present invention relates to microphones in general, and particularly to microphones for use on location.

When a performer works in a studio, whether it is a sound studio, a movie studio, or a television studio, the director is able to maintain communications with the performer by means of hand signals and visible signs. The performer always knows when he is addressing a live microphone as a result of this communication. The fact that so much equipment is assembled in close relationship, however, does create certain problems, such as the introduction of hum onto the microphone line, loss of microphone signals due to poor connections, and loss of signal due to the failure of any battery associated with the microphone. Accordingly, engineers have carefully developed microphone cabling systems which avoid such problems under normal circumstances. The microphone cables used in studios are designed to operate at relatively high signal levels, requiring an amplifier between most microphones and the microphone cable. The high signal levels reduce the likelihood of hum. Power for the amplifier is provided directly from the cable through a system referred to as Phantom power, rather than using a battery which may lose its potential.

When a microphone is used on location, such as interviews at political conventions, or interviews on the sidewalk or any other place away from the studio, the engineers attempt to create the same environment for the microphone as used in the studio. The microphone in most cases continues to be powered by a Phantom power source through the microphone cable, thereby avoiding the necessity of maintaining a fresh battery in the microphone during operation. In like manner, the high signal levels produced by the microphone minimize the likelihood of hum even though the sound is originating on location.

Even though the equipment used on location simulates the equipment in a studio, the results are not always the same. In the first place, the performer can no longer see the director, and the performer must rely on a communications system with a headphone to know whether or not he holds a live microphone in his hand. Also, the likelihood of an open circuit in the microphone cable is increased, including the likelihood that the Phantom power will fail even though audio connections remain.

It is an object to provide a microphone which is provided with an indicator to tell the performer when the microphone is live, and particularly such a microphone which is suitable for use on location. This object must be accomplished without an adverse effect on the performance of the commercial microphone cabling system.

In the conventional studio and portable location equipment, it is customary to provide Phantom power to both dead and live microphones. The director switches a microphone on and off, but the act of switching a microphone on or off does not effect a change in the Phantom power from the cable to that microphone. It is an object of the present invention to provide a Phantom power source provided with means to generate a signal superimposed on the Phantom power for the microphone and a microphone assembly provided with an indicator and means coupled to the indicator responsive to the signal from the Phantom power source to actuate the indicator.

It is a further object of the present invention to provide a microphone assembly provided with a direct current battery connected in a circuit to provide power to the microphone assembly for use at locations which lack Phantom power or for use during periods in which the Phantom power on the microphone cable fails.

It is a still further object of the present invention to provide a microphone suitable for use on location which is provided with a visible indicator to indicate the magnitude of the electromotive force of the standby battery.

All of the foregoing objects of the present invention are to be achieved in a light weight, simple structure which will not materially reduce the portability of the microphone assembly.

The present invention, together with additional objects and advantages, is illustrated in the attached drawings, in which.

Figure 1:
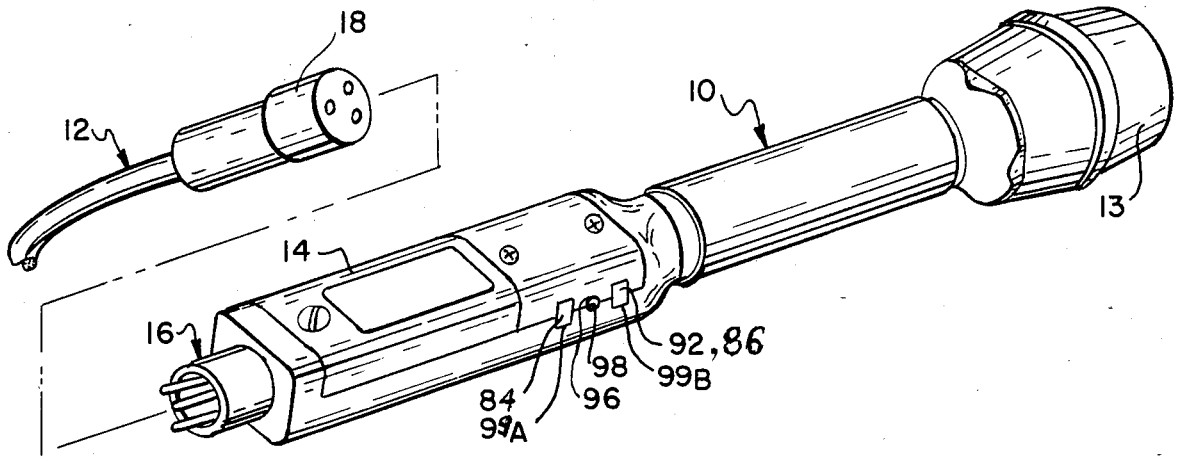
FIG. 1 is an isometric view of a microphone assembly constructed according to the teachings of the present invention.

FIG. 1 illustrates a microphone assembly 10 which embodies the present invention and a microphone cable 12 of conventional design. The microphone 10 has a forward housing 13 which contains the microphone element itself, and a rearward housing 14 which accommodates the electrical circuits used in association with the microphone element which will be described hereinafter. The assembly 10 has a male connector 16 at its rearward end to accommodate the female connector 18 of the microphone cable 12.

Figure 2:
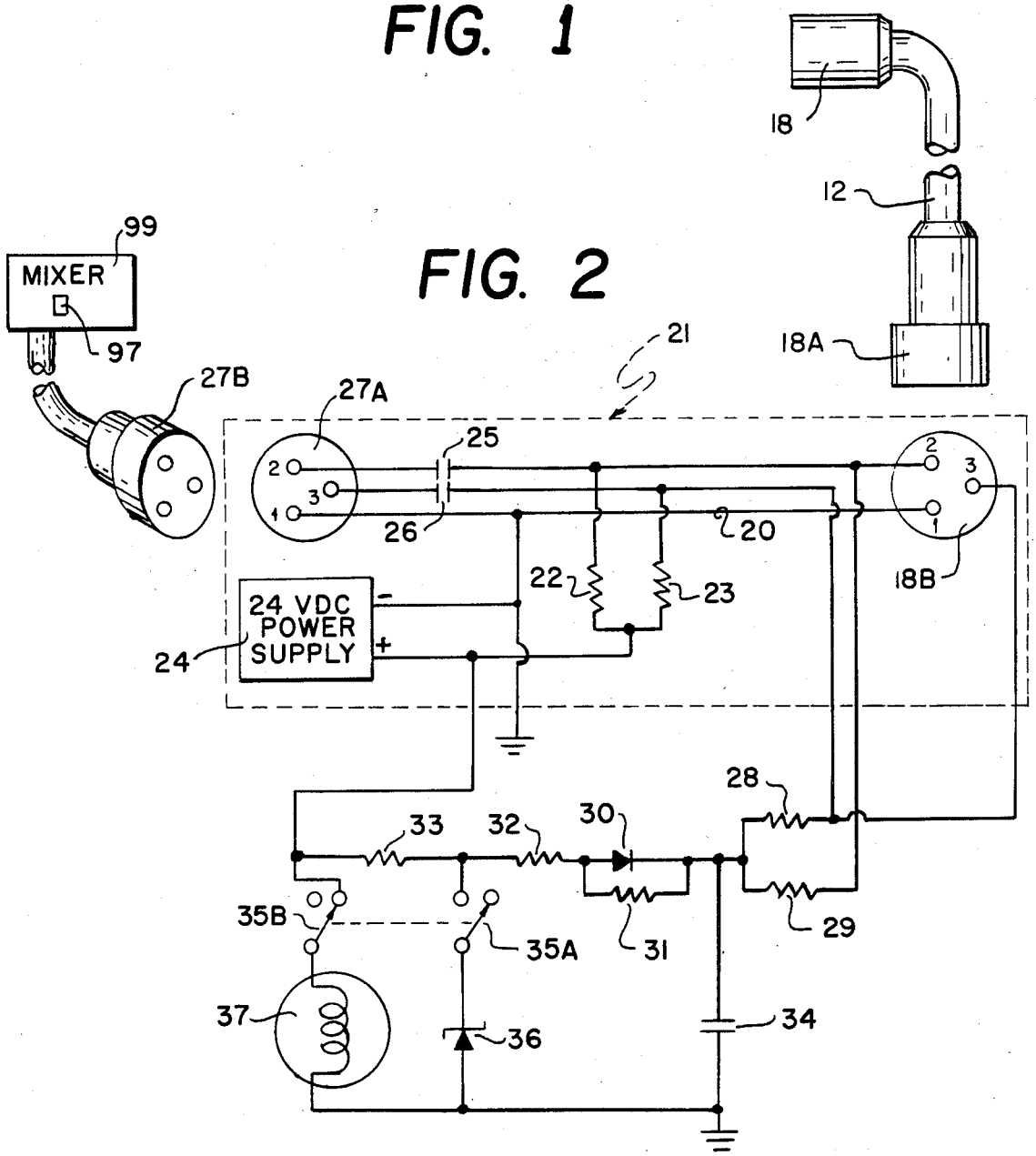
FIG. 2 is a schematic electrical circuit diagram of the studio microphone cabling equipment including the Phantom power source.

FIG. 2 illustrates the electrical circuits of the microphone cabling equipment and the microphone cable 12. The cable 12 is a three wire cable extending between the connector 18 and a second connector 18A. The connector 18A is mated to a 3 wire connector 18B which is mounted on the electronic unit (not shown) of the cabling equipment. The connector 18B has three terminals, terminal 1 being connected to a ground lead 20 of the electronic unit designated 21 in FIG. 2. A pair of resistors 22 and 23 are connected in series between terminals 2 and 3 of the connector 18B, and the positive terminal of a battery 24 (or other direct current power source) is connected to the junction between the resistors 22 and 23, the negative terminal being connected to the ground lead 20. In conventional studios, the battery 24 may have a direct current potential of 24 volts. The audio signal from the microphone is conducted from the connector 18B by a pair of condensers 25 and 26 connected to terminals 2 and 3 of the connector 18B, respectively, to a two part connector 27A and 27B for connection to a mixer 99. It should be understood that commercial sound studios, broadcast stations and the like, provide the portion of the circuit of FIG. 2 described above and shown within a dashed line box designated 21, and commercial microphones are constructed to utilize the direct current power available from the microphone cable, this power being referred to in the microphone art as Phantom power.

FIG. 2 also illustrates the means by which a signal is superimposed upon the Phantom power generated by the conventional electronics unit 21. In the embodiment of FIG. 2, the signal is in the form of an increased potential superimposed upon the normal Phantom power potential.

As illustrated in FIG. 2, a pair of resistors 28 and 29 are connected in series and across terminals 2 and 3 of the connector 18B. The junction between resistors 28 and 29 is connected to the positive terminal of the power source 24 through a diode 30 connected in parallel with a resistor 31, and two serially connected resistors 32 and 33. A capacitor 34 is connected between the junction of resistors 28 and 29 and the ground lead 20. The junction between resistors 32 and 33 is connected through a single pole single throw switch 35A and a zener diode 36 polarized to regulate positive potential from the negative lead 20. A second single pole single throw switch 35B, which is ganged with a switch 35A, and a pilot lamp 37 are connected in series between the negative lead 20 and the positive terminal of the battery or power source 24.

The zener diode 36, when connected through a closed switch and the resistor 33 between the positive and negative terminals of the power source 24, will break down and maintain the junction between the resistors 32 and 33 at approximately the zener potential, namely twelve volts in this particular case. As a result, the potential of the Phantom power applied to the microphone will be below the potential necessary to actuate the indicator 96, as will be hereinafter explained. On the other hand, when the switch 35 is open, the capacitor 34 will gradually charge through resistors 31,32 and 33 to achieve a potential greater than the Phantom power potential provided through resistors 22 and 23, this latter higher potential being sufficient to activate the indicator as will be hereinafter more fully explained. By means of the capacitor 34, and the resistors 31 and 32 and the diode 30, opening or closing of the switches 35A and 35B will not result in an abrupt voltage change being impressed upon the cable 12 which will produce an electrical response translatable to an audio response.

Figure 3:
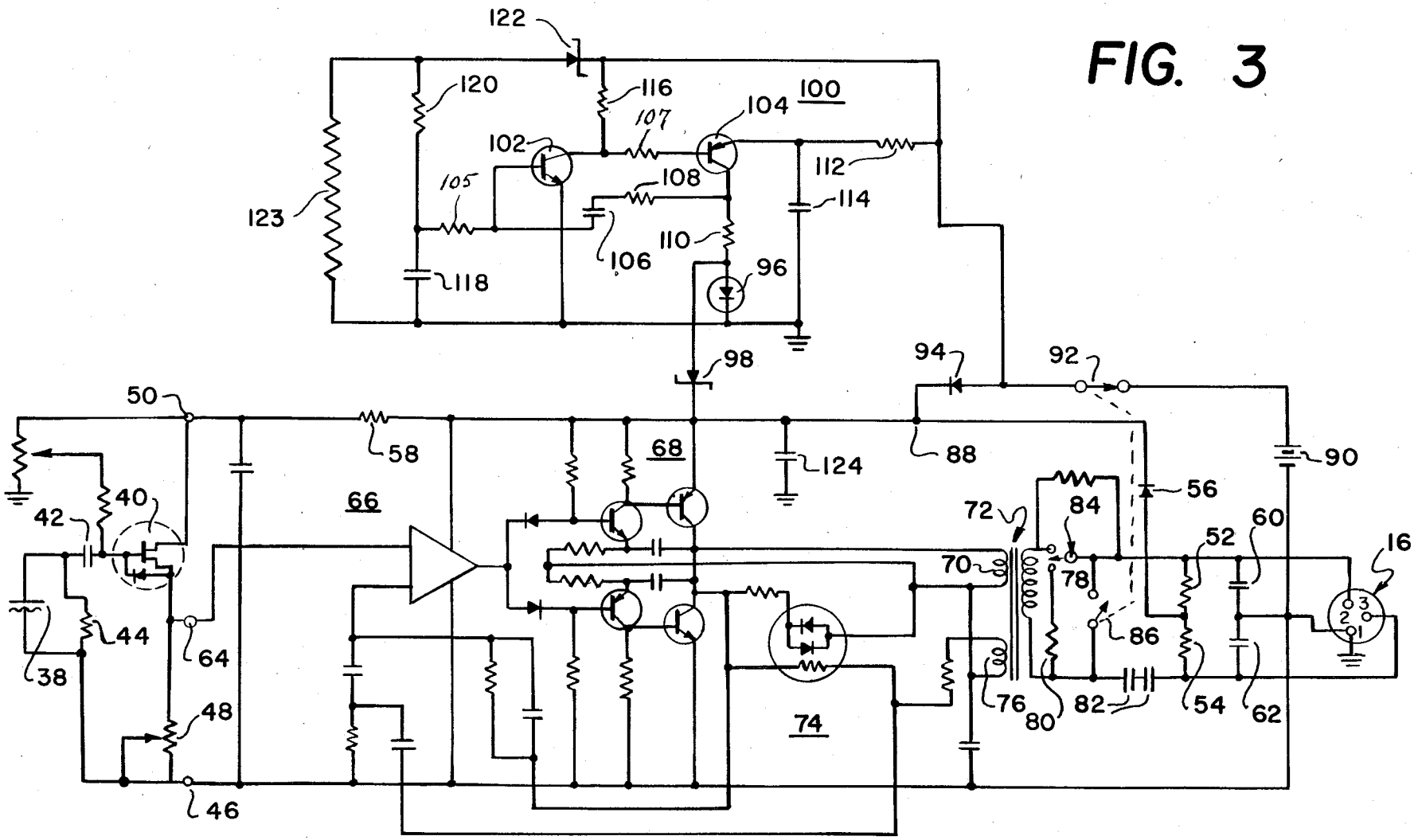
FIG. 3 is an electrical circuit diagram of the electrical components of the microphone assembly illustrated in FIG. 1.

FIG. 3 illustrates in the form of a schematic electrical circuit diagram the electrical elements of the microphone assembly 10 illustrated in FIG. 1. The microphone unit disposed in the forward housing 13 of the microphone assembly 10 is an electret microphone 38 which is coupled to a field effect transistor 40 connected in a follower circuit through a capacitor 42. A resistor 44 is connected in parallel with the electret microphone to provide a low frequency roll-off.

The source of the field effect transistor 40 is connected to the ground wire 20 through a terminal 46 and a variable resistor 48, and the drain is connected to the positive supply terminal 88, through a terminal 50 and decoupling resistor 58. Terminal 88 is connected to terminals 2 and 3 of the connector 16 through matched resistors 52 and 54, respectively, and steering diode 56. A pair of capacitors 60 and 62 are connected in series between terminals 2 and 3 of connector 16 to suppress RF interference and the junction between the capacitors is grounded.

The source of the field effect transistor 40 is connected to a terminal 64 and the input of an operational amplifier 66 is connected between the terminals 46 and 64. The output of the operational amplifier 66 is connected to the input of a two stage amplifier 68 to amplify the signals from the electret microphone 38 to the conventional signal level used on microphone cables in commercial sound studios. The output of the amplifier 68 is connected to the input winding 70 of the transformer 72 through a volume compressing circuit 74 which prevents overload. A tertiary winding 76 on the transformer 72 is utilized to generate negative feedback to the operational amplifier 66 to correct for distortion in the audio signal, including distortion produced by external magnetic fields at low frequencies.

The transformer 72 also has a secondary winding 78 which is connected between terminals 2 and 3 of connector 16, through a pair of capacitors 82. These capacitors are in back to back polarity in series between terminal 3 and the winding 78 to block the passage of D. C. current of either polarity. A switch 84 is connected between terminal 2 of the connector 16 and the secondary winding 78. The switch 84 has one position in which the winding 78 is connected between terminals 2 and 3 of connector 16, and a second position in which a resistor 80 is connected between terminals 2 and 3. Also, a switch 86 is connected between the pole terminal of switch 84 and the junction of one of the capacitors 82 and the secondary winding 78, and when the switch 86 is closed all audio signals are prevented from passing from the microphone 38 to the connector 16, thereby assuring complete cutoff of audio signals.

The diode 56 conducts positive charges of the Phantom power from the connector 16 to the positive terminal of the amplifiers 66 and 68, this terminal being designated 88. When driven by the Phantom power through the diode 56, the terminal 88 is at a positive potential with respect to the ground terminal 1 of the connector 16 of approximately 9.7 volts, switch 35A being closed.

The negative terminal of a battery 90 is connected to terminal 1 of the connector 16, and the positive terminal of battery 90 is connected through a switch 92 and a diode 94 to the positive terminal 88 of the amplifiers 66 and 68. The switches 86 and 92 are ganged together with a common actuator.

The steering diode 94 is connected to allow the battery 90, which may be a conventional 9 volt transistor or alkaline battery, to supply positive charges to terminal 88 whenever switch 92 is closed and the Phantom supply is not activated. Furthermore, diode 56 prevents the battery from discharging into the Phantom supply network when Phantom power is not present. However, when the Phantom power through diode 56 exceeds the potential of the battery 90, namely 9 volts, no power will pass from the battery to the positive terminal 88 of the amplifiers.

Because the Phantom power potential is 9.7 volts, the battery 90 will not drain through diode 94, but if the Phantom power falls, diode 56 will become reverse biased, and battery 90 will drain through diode 94 and power the FET 40, the operational amplifier 66, and the signal amplifier 68.

The microphone assembly 10 is provided with an indicator in the form of a light emitting diode 96 which is visible through an aperture 98 in the rearward housing 14 of the microphone assembly, the actuators of switches 84, 86 and 92 being actuable through apertures 99A and 99B located on opposite sides of the indicator 96, respectively, as illustrated in FIG. 1. The diode 96 is connected to the positive terminal 88 of the amplifiers 66 and 68 through a zener diode 98 with a zener breakdown potential of 8.2 volts. The light emitting diode 96 requires a potential of approximately 1.7 volts to conduct and therefore the potential on terminal 88 must be at least 9.9 volts to cause diode 96 to conduct and produce a constant illumination. When the Phantom power developed with respect to ground on terminals 2 and 3 of connector 18B through resistors 22 and 23 is of the order of 9 volts direct current, it will not cause the light emitting diode 96 to conduct. However, when the switch 35A is open, the increased potential developed on terminal 2 and 3 of connector 18B with respect to ground will cause the voltage at terminal 88 to rise to approximately 12.5 volts direct current, and thus be sufficient to cause diode 96 to conduct and illuminate. If the Phantom power fails, then terminal 88 will be powered by battery 90 through diode 94, and the potential will fall on terminal 88 from in excess of 9.9 volts to about 9 volts, the potential of the battery 90. Accordingly, the potential difference across diode 96 will fall to significantly less than the 1.7 volts required to maintain conductivity through the diode 96 and illumination, and the light emitting diode 96 will be extinguished to indicate that Phantom power has failed.

In practice, the ganged switches 35A and 35B are actuated simultaneously with a switch 97 in a mixer 99, the switch 97 connecting the mixer to sound signals from the microphone assembly 10. As a result, opening of the switch 35A causes the light emitting diode 96 to signal the presence of a live microphone assembly 10.

The battery 90 also provides positive potential to power a multivibrator 100. The free running multivibrator 100 uses an NPN transistor 102 driving a PNP transistor 104 in a circuit which sends current pulses through LED 96, causing it to flash at a rate which is a function of the D.C. voltage of the battery 90.

Upon closing switch 92, storage capacitor 114 will begin to charge through current limiting resistor 112, approaching the value of the battery potential. Simultaneously, capacitor 118 will begin to charge through zener diode 122 and resistor 120 at a much slower rate. This timing difference assures that capacitor 114 will be fully charged before initial circuit action begins. The potential across capacitor 118 is applied between the base and emitter of transistor 102 through resistor 105 and charges capacitor 106. As soon as this potential reaches approximately 0.6 volts, transistor 102 conducts, drawing positive charges from collector to emitter and then back to the negative terminal of battery 90 (ground). The collector voltage of transistor 102 drops to near ground potential and is coupled to the base of transistor 104 through protection resistor 107. Since the emitter of transistor 104 is connected to the positive terminal of capacitor 114, which has become fully charged, the base emitter junction of transistor 104 becomes forward biased, the transistor 104 turns on, and a large pulse of current flows as capacitor 114 discharges through transistor 104, current limiting resistor 110, and the LED 96, causing diode 96 to flash brightly.

When transistor 104 switches on, resistor 108 is pulled positive, to approximately the potential of capacitor 114, and this positive pulse is coupled back to the base of transistor 102 in the regenerative manner of a multivibrator, assuring that both transistors remain fully on (saturated). As capacitor 114 becomes discharged, the potential on the collector of transistor 104 becomes less positive, which causes a negative going pulse to be coupled through resistor 108 and capacitor 106 onto the base of transistor 102. This causes transistor 102 to turn off, since its base is driven to a substantial negative potential. Because of the previously mentioned coupling between transistors through resistor 107, transistor 104 is also turned off. After the transistors turn off, positive charges flowing from the battery 90 through zener diode 122, resistor 120, and resistor 105, slowly charge capacitor 106. This results in a voltage ramp at the base of transistor 102, making it less and less negative, and, eventually, positive. When this base rises to approximately positive 0.6 volts, transistor 102 turns on, repeating the entire cycle. The flash rate depends upon the slope of the voltage ramp generated by charging capacitor 106. The rate therefore depends principally upon the values of capacitor 106, resistor 105, resistor 120, the voltage across zener diode 122, and the battery 90 voltage. Since all components values are fixed by design, the flash rate can be used to indicate battery voltage. A lower battery voltage will result in slower charging of capacitor 106, and thus a slower flash rate.

When the voltage of battery 90 fall below the value of zener diode 122 plus 0.6 volts, flashing will cease, since capacitor 106 cannot reach the turn-on threshold of transistor 102. Selection of diode 122 voltage may be made to provide a suitable flash threshold to indicate the desired end-of-life voltage of battery 90. The zener diode 122 is of a type chosen for stable voltage drop (knee) at very low current in order to conserve battery drain. Resistor 123 provides a small bias current through the diode 122 to insure operation above the knee under all conditions. Since the voltage ramp at the base of transistor 102 is very much larger than the base emitter turn-on voltage of 0.6 volt, the flash rate is essentially independent of temperature over the usable range of the microphone.

Since both transistors 102 and 104 turn on and off together, and since they are on only during a very short portion of a flash cycle, namely, while capacitor 114 is discharging (small duty cycle), the average current drawn by transistor 102 is very low, conserving battery life.

The power required to cause diode 96 to flash is produced by discharge of capacitor 114 and not drawn directly from the battery itself. Only a very small battery current flows through the high value resistance 112 over the relatively long period of time between flashes to recharge capacitor 114. Therefore, no high current spikes are present in the battery supply, which could result in voltage variations affecting the audio performance of the amplifiers 66 and 68. However, the high current pulse through the LED 96, however brief, gives a flash which is subjectively very bright to the human eye.

Since power for the multivibrator 100 is provided only from the battery 90, the diode 94 isolating the multivibrator 100 from the Phantom power, operation of the multivibrator 100 is independent of Phantom power. Hence, the rate of oscillation of the multivibrator 100 is a measurement of battery potential, and can be determined by observation of the light emitting diode 96. Because the multivibrator uses relatively little current, there is little drain on the battery as a result of this measurement of its potential. During periods in which Phantom power is applied to the positive terminal 88 and switch 35A is open, the light emitting diode 96 will conduct continuously, and the continuous illumination of diode 96 will partially but not entirely mask the indication of battery potential. However, during periods in which the battery 90 is powering the amplifiers 66 and 68, the light emitting diode will indicate the magnitude of the potential of battery 90 by the rate at which pulses of light are emitted.

While the present invention is particularly adapted to use of an electret or other type of condenser microphone, since such microphones produce low level outputs requiring amplification directly at the microphone, the present invention may also be practiced utilizing a dynamic microphone or some other type of microphone. The amplifier 68 may still be required to obtain sufficient signal to achieve normal microphone cable signal levels.

Those skilled in the art will devise many applications and uses for the present invention above and beyond that described in the present specification. It is therefore intended that the scope of the present invention be not limited by the foregoing disclosure, but rather only by the appended claims.

The invention claimed is:

1. A device for connecting a microphone to a microphone cable system, the cable system being adapted to conduct audio signals and having at least two conductors and a direct current source connected across the two conductors, comprising an audio amplifier having an input adapted to be coupled to the microphone and an output, said amplifier having two terminals for connection to a direct current source of power, coupling means connected to the output of the amplifier and adapted to be connected to the microphone cable system for coupling audio signals from the amplifier to the microphone cable system, said coupling means isolating the direct current power of the microphone cable system from the output of the amplifier and including a diode connected to one of the amplifier power input terminals, said diode being connected to pass current from the microphone cable system to said amplifier to power the amplifier, a light emitting diode and a zener diode connected in series across the power input terminals of the amplifier, the zener diode being polarized against the flow of current to the light emitting diode and having a breakdown potential below the potential of the direct current source of the microphone cable system.

2. A device for connecting a microphone to a microphone cable system comprising the combination of claim 1 in combination with a battery having a direct current potential less than the potential of the breakdown potential of the zener diode, a second diode connected in a series circuit with the battery and one of the power input terminals of the amplifier to pass direct current to the amplifier to power the amplifier during periods in which the potential of the direct current source associated with the microphone cable is less than the potential of the battery, and means electrically connected in parallel with the battery including an indicator for measuring the potential of the battery.

3. A device for connecting a microphone to a microphone cable system comprising the combination of claim 2 wherein the means for measuring the potential of the battery comprises a free running multivibrator having a positive and a negative power input terminal, the positive and negative power input terminals being connected to the positive and negative power input terminals of the battery, said multivibrator having an output circuit including a light emitting diode.

4. A device for connecting a microphone to a microphone cable system comprising the combination of claim 3 wherein a single light emitting diode is electrically connected in series with both the multivibrator output circuit and the zener diode.

5. A device for connecting a microphone to a microphone cable system comprising the combination of claim 3 wherein the output circuit of the multivibrator includes, in series, the battery, the light emitting diode, a transistor having a collector and an emitter, and a resistor in combination with a condenser connected in parallel with the transistor and light emitting diode, the time for charging the condenser through the resistor being less than the repetition rate of the multivibrator.

6. A device for connecting a microphone to a microphone cable system comprising the combination of claim 5 wherein the repetition rate of the multivibrator varies directly with the magnitude of the potential of the battery.

7. A microphone and microphone cable system comprising a microphone having two output terminals for audio signals generated by the microphone, an amplifier having two input terminals for audio signals, said amplifier also having two power terminals adapted to be connected to a direct current power source, the input terminals of the amplifier being coupled to the terminals of the microphone, a cable system having a cable with two conductors coupled at one end to the output terminals of the amplifier and a third conductor connected to one of the power terminals of the amplifier, a pair of resistors connected in series between the two conductors at said one end of the cable, the junction between said resistors being electrically connected to the other power terminal of the amplifier, a light emitting diode and a zener diode connected in series between the two power terminals of the amplifier, the zener diode being back polarized to pass current to the diode only for potentials in excess of its zener potential, a source of direct current having a potential greater than the zener potential provided with two output terminals, a second pair of resistors connected in series between the other end of two of the conductors of the cable, the junction between the resistors of said second pair being electrically connected to one terminal of the direct current source, the other terminal of the direct current source being electrically connected to the other end of the third conductor of the cable, and means for switching the potential between the two conductors of the cable and the third conductor between a potential less than the zener potential and a potential greater than the zener potential.

8. A microphone and microphone cable system comprising the combination of claim 7 wherein the means for switching the potential between the two conductors of the cable and the third conductor comprises a third pair of resistors connected in series between the two conductors, a resistor connected between the junction between the resistors of the third pair and the junction between the resistors of the second pair, and a switch and a second zener diode connected in series between the junction of the resistor and third pair of resistors and the third conductor of the cable, the second zener diode having a zener potential lower than the zener potential of the first zener diode.

* * * * *